US009828818B2

(12) United States Patent
Churchill

(10) Patent No.: US 9,828,818 B2
(45) Date of Patent: Nov. 28, 2017

(54) DOWNHOLE APPARATUS

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 220 days.

(21) Appl. No.: 14/403,028

(22) PCT Filed: May 20, 2013

(86) PCT No.: PCT/GB2013/051302
§ 371 (c)(1),
(2) Date: Nov. 21, 2014

(87) PCT Pub. No.: WO2013/175189
PCT Pub. Date: Nov. 28, 2013

(65) Prior Publication Data

US 2015/0136416 A1 May 21, 2015

(30) Foreign Application Priority Data

May 22, 2012 (GB) ..... 1209012.2

(51) Int. Cl.
*E21B 23/08* (2006.01)
*E21B 23/04* (2006.01)
(Continued)

(52) U.S. Cl.
CPC ..... *E21B 23/08* (2013.01); *E21B 23/00* (2013.01); *E21B 23/04* (2013.01); *E21B 2034/002* (2013.01)

(58) Field of Classification Search
CPC ..... E21B 34/16; E21B 23/00; E21B 23/04; E21B 2034/002; E21B 23/08
See application file for complete search history.

(56) References Cited

U.S. PATENT DOCUMENTS 8,505,632 B2 * 8/2013 Guerrero ..... E21B 33/12 166/318
2007/0272412 A1 * 11/2007 Telfer ..... E21B 23/00 166/318

(Continued)

FOREIGN PATENT DOCUMENTS

EP 2372080 A2 10/2011
WO 02097234 A1 12/2002
WO 2011/061239 A2 5/2011

OTHER PUBLICATIONS

International Search Report for PCT/GB2013/051302 filed May 20, 2013.

*Primary Examiner* — Brad Harcourt
(74) *Attorney, Agent, or Firm* — Dinsmore & Shohl LLP

(57) ABSTRACT

Downhole apparatus comprises first and second tools for location in a tubing string. The first tool has a first seat of a first diameter and the second tool has a second seat of a second diameter larger than the first diameter. First and second activating devices are provided for use in activating the respective first and second tools. The first activating device includes a first activating profile having an extended diameter larger than the first diameter and smaller than the second diameter and a retracted diameter smaller than the first diameter. The second activating device includes a second activating profile having an extended diameter larger than the second diameter and a retracted diameter smaller than the first diameter.

39 Claims, 5 Drawing Sheets

(51) Int. Cl.
*E21B 23/00* (2006.01)
*E21B 34/00* (2006.01)

(56) References Cited

U.S. PATENT DOCUMENTS

| | | | | |
|---|---|---|---|---|
| 2008/0000697 | A1* | 1/2008 | Rytlewski | E21B 43/14 175/317 |
| 2010/0252280 | A1 | 10/2010 | Swor et al. | |
| 2010/0294515 | A1 | 11/2010 | Xu | |
| 2010/0319924 | A1 | 12/2010 | Mahmoud et al. | |
| 2011/0108284 | A1* | 5/2011 | Flores | E21B 34/14 166/373 |
| 2011/0127047 | A1 | 6/2011 | Themig et al. | |
| 2011/0240301 | A1 | 10/2011 | Robison et al. | |
| 2012/0073828 | A1* | 3/2012 | Churchill | E21B 21/103 166/373 |
| 2013/0081827 | A1* | 4/2013 | Etzel | E21B 34/14 166/386 |

* cited by examiner

DOWNHOLE APPARATUS

CROSS-REFERENCE TO RELATED APPLICATIONS

This application is the U.S. National Phase of PCT/GB2013/051302 filed May 20, 2013, which claims priority of Great Britain Patent Application 1209012.2 filed May 22, 2012.

FIELD OF THE INVENTION

This invention relates to downhole apparatus and to a downhole method, and in particular to an apparatus which facilitates activation of multiple tools in a tubing string, such as a drill string.

BACKGROUND OF THE INVENTION

In the drilling of subterranean bores or wells, and in subsequent downhole operations, such as required in the oil and gas industry, it is typically the case that a single string of tubing, such as a drill string, will contain multiple tools. For example, a drill string may include a drill bit, a downhole motor, an agitator, MWD tools, an under-reamer, a bypass tool and so on. The same is true of other strings as may be employed in fishing or milling operations, or strings utilised in running completions, packers, valves, plugs and the like. Activation of these tools is possible by a number of means. However, one of the most convenient and reliable methods of activating a downhole tool is to utilise fluid pressure. In such a tool, hydraulic pressure in the string, generated by surface pumps, acts across at least a part of the tool to create an activating force. Such a force may be generated by providing a flow restriction in the tool. This restriction may be a permanent feature of the tool, however such a permanent restriction will induce pressure losses in the fluid being pumped through the restriction, and will limit access to the portion of the string below the restriction. Accordingly, many tools employ activating devices, which may be in the form of balls or darts, which are dropped or pumped from surface to land on a seat provided in the tool. The activating device may wholly or partly occlude the string bore, facilitating creation of a pressure differential across the device and the seat, and thus the creation of a potentially significant activating force.

Following activation of the tool, the activating device or seat may be reconfigured to allow the device to pass through the seat, and land in a catcher provided below the tool, allowing fluid flow through the tool, and the string, to be restored.

Where multiple tools are provided in a string and it is desired to activate the tools using activating devices dropped or pumped from surface, this may be achieved by providing the tools with seats of progressively smaller diameters. For example, a first tool closer to the distal end of the string may have ball seat which is smaller than a ball seat provided in a second tool provided closer to surface. Thus, an activating ball for the first tool will be sized to pass through the ball seat in the second tool before landing on the ball seat of the first tool. However, in such an arrangement it is only possible to activate the tools in order of their proximity to the distal end of the tool, as once the second tool has been activated there is no access to allow activation of the first tool. This places severe restrictions on the utility of such tools.

SUMMARY OF THE INVENTION

According to the present invention there is provided downhole apparatus comprising:

first and second tools for location in a tubing string, the first tool having a first seat of a first diameter and the second tool having a second seat of a second diameter larger than the first diameter, and first and second activating devices for use in activating the respective first and second tools, the first activating device including a first activating profile having an extended diameter larger than the first diameter and smaller than the second diameter and a retracted diameter smaller than the first diameter, and the second activating device including a second activating profile having an extended diameter larger than the second diameter and a retracted diameter smaller that the first diameter.

According to another aspect of the present invention there is provided a tool activating method comprising:

providing first and second tools in a tubing string, the second tool being located above the first tool in the string, the first tool having a first seat of a first diameter and the second tool having a second seat of a second diameter larger than the first diameter;

providing first and second activating devices for use in activating the respective first and second tools, the first activating device including a first activating profile with an extended diameter larger than the first diameter and smaller than the second diameter and a retracted diameter smaller than the first diameter, and the second activating device having a second activating profile with an extended diameter larger than the second diameter and a retracted diameter smaller that the first diameter;

passing the second activating device through the string such that the second activating profile engages the second seat;

activating the second tool;

retracting the second activating profile from the extended diameter to the retracted diameter; and passing the second activating device through the second seat and then through the first seat.

The method may further comprise subsequently passing the first activating device through the string such that the first activating device passes through the second tool and the first activating profile then engages the first seat, allowing activation of the first tool. The first activating profile may then be retracted, and the first activating device passed through the first seat.

The present invention thus permits a second tool, above a first tool in a tubing string, to be activated by an appropriate activating device, the activating device then reconfigured and passed down through the second and first tools, and the first tool subsequently activated by an appropriate activating device.

The apparatus may further comprise a third tool and a third activating device, the third tool having a third seat of a third diameter larger than the second diameter, and the third activating device including a third activating profile having an extended diameter larger than the third diameter and a retracted diameter smaller that the first diameter. Further, those of skill in the art will recognise that further tools and activating devices may be provided with respective larger diameter seats and extended diameter activating profiles, and with retracted activating profile diameters smaller than the first diameter.

The tubing string may be of any appropriate form, for example a drill string, fishing string, milling string, running string, tool string, casing, liner, or a completion, or any appropriate combination of string elements, for example a running string and a liner string.

The tools may be of any appropriate form, including but not limited to: drill bits, reamers, downhole motors, agitators, MWD tools, LWD tools, downhole steering tools, stabilisers, under-reamers, bypass tools, fishing tools, milling tools, cutting tools, tubing expanders, setting tools, packers, valves, plugs, hangers, perforating guns, fracturing sleeves, stimulation tools, inflow control devices (ICDs) and the like. Of course different tools may be combined on the same string. For example tools may be provided to permit an operator to set a pair of packers to isolate a section of formation. A tool located between the packers may then be utilised to open (and subsequently close) a transverse port to permit fracturing of the section. A further tool located between the packers may then be actuated to open an ICD.

The tools may have utility independently of the activating devices, or may provide the desired utility only in combination with an appropriate activating device.

The first and second tools may form part of a single tool or apparatus requiring or capable of multiple activations.

The tools may all perform a similar function, but be located at different points in the string. For example, a first bypass tool may be provided in or directly above the bottom hole assembly (BHA) on a drill string, for use in supplying lost circulation material (LCM), while a second bypass tool may be provided further up the drill string for use in facilitating drilling fluid circulation and drill cuttings removal. Alternatively, or in addition, tools capable of performing different functions may be provided in a single string.

The activating devices may be of any appropriate form, and will of course be configured for cooperation with the respective tool. Thus, the activating devices may be of the same or similar form, or may take different forms.

An activating device may be configured to substantially occlude the string when landed on the respective seat, while another activating device may only partially occlude the string, or indeed provide minimal, if any, flow restriction. Such partial occlusion may be provided by a nozzle or other flow restriction, which restriction may be configured to resist wear, or alternatively to erode such that the degree of occlusion reduces over time.

The activating devices may have profiles formed in any appropriate manner, for example the devices may be configured to allow the profiles to retract and pass through subsequent seats. For example, the activating devices may be the same or similar to those disclosed in applicant's International Patent Application publication number WO/2010/128287, the disclosure of which is incorporated herein in its entirety.

The activating profiles may be reconfigured between the extended and retracted configurations by any appropriate means, and the profiles of different activating devices may be reconfigured by different or the same means. Elevated fluid pressure may be utilised to reconfigure the profiles. Alternatively or in addition, a release device may be passed through the string to reconfigure the profile, or a release device may be integral with the activating device. The release device may apply a mechanical force to the respective activating device, or the release device may reconfigure the profile by non-contact means, such as a magnet which releases a magnetic switch, or by carrying an RF transmitter which transmits a reconfigure signal to the activating profile. Alternatively or in addition, the activating profiles may be reconfigured after a predetermined time interval, for example by operation of a timed switch, or may be reconfigured by exposure to a particular medium, for example the activating device may incorporate a swelling elastomer which swells with exposure to a downhole fluid and will be arranged to reconfigure the profile after a predetermined period of exposure, or the activating device may include an element which is eroded by fluid flow and allows the profile to reconfigure after a predetermined period or degree of erosion. Activating devices which are reconfigured by non-fluid pressure arrangements will of course have particular utility in applications in which the activating device will experience elevated fluid pressure during the activation or actuation of the associated tool.

The differences in the first and second diameters may be relatively small, and this may be facilitated by forming the seats and activating profiles of relatively hard or otherwise non-deformable materials, such Tungsten Carbide or suitable ceramics.

At least one activating profile may be formed by a member or members which are retractable from the extended diameter to define a smaller retracted diameter.

At least one activating profile may be biased to assume the extended diameter, for example being formed by sprung elements, which elements may be supported to define the extended diameter. If the support is removed, the profile may be deflected to assume the retracted diameter.

At least one activating profile may be biased to assume the retracted diameter. Such a profile may be supported to define the extended diameter, and when the support is removed the profile assumes the smaller retracted diameter.

The apparatus may include an activating device catcher, and the catcher may be located below the first tool. The catcher may permit fluid bypass around any activating devices held in the catcher. The catcher may include a no-go, or seat, with a diameter smaller than the first diameter. The catcher may be dimensioned to accommodate multiple activating devices.

One or both of the activating devices and seats may include seals, although typically any seals will be provided on the activating devices. The seals may be provided above, below, or on the activating profiles. If the seals are provided separately of the respective profiles, or are otherwise not configured to assume a retracted configuration, the seals should have sufficient flexibility to allow the seals to pass through any subsequent seats.

One or more of the activating devices and seats may include latch arrangements, wherein the activating devices are releasably retained on the seats, or are at least restrained from unrestricted movement relative to the respective tool. Examples of some suitable latch configurations are described in applicant's WO/2010/128287, the disclosure of which is incorporated herein in its entirety.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
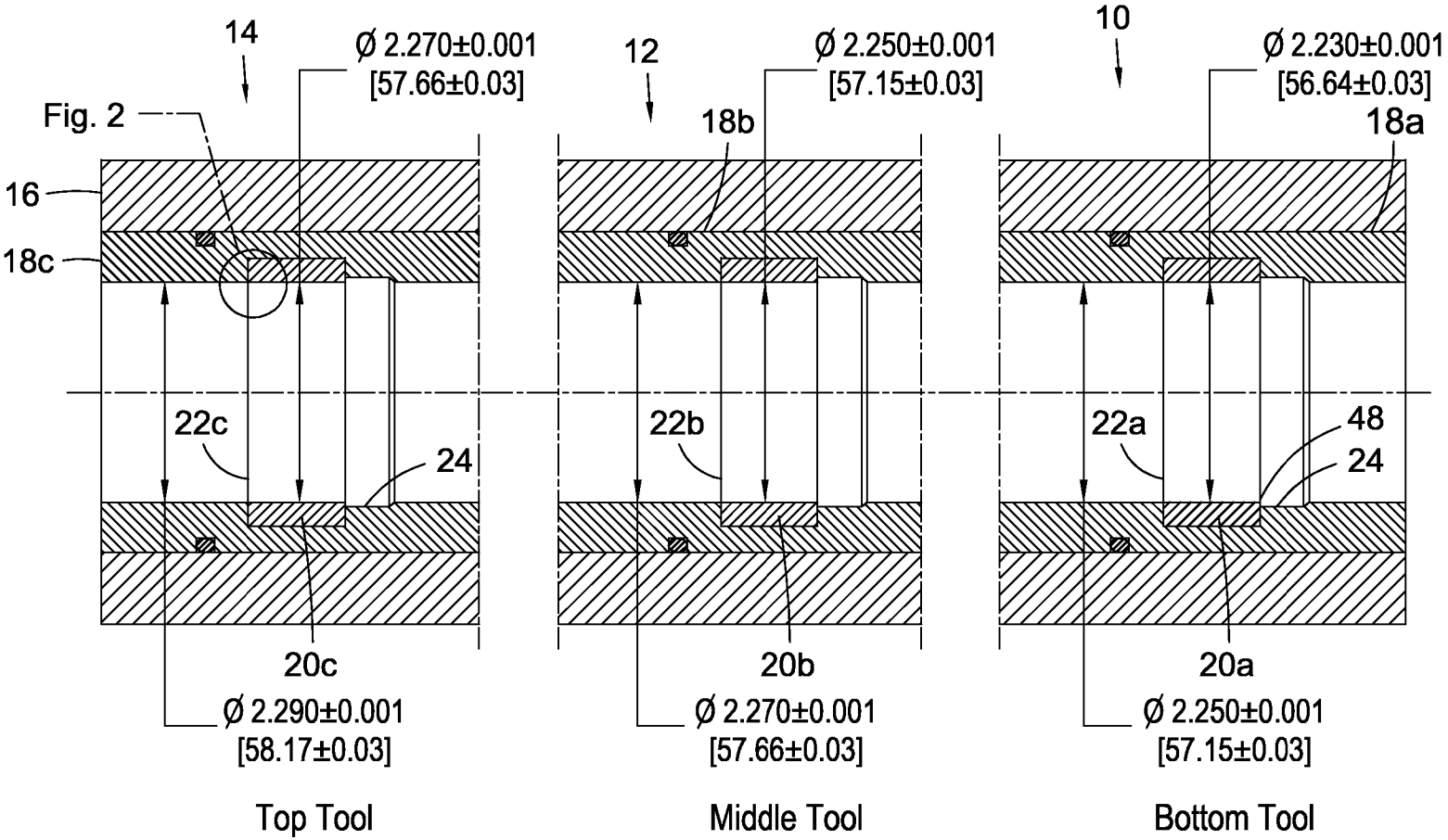
FIG. 1 is a sectional view of activating parts of three different tools, in accordance with an embodiment of the present invention.

Reference is first made to FIG. 1 of the drawings, which is a sectional view of activating portions of three different downhole tools, a first or bottom tool 10, a second or middle tool 12, and a third or top tool 14. The tools 10, 12, 14 are mounted in a drill string with the first tool 10 located closest to the distal end of the string, and the third tool 14 located closest to surface. Each tool includes a tubular body 16 and a sliding sleeve 18. The bodies 16 are configured for forming part of an appropriate downhole string and thus will be provided with appropriate end connections (not shown). The tools 10, 12, 14 are activated by the respective sleeve 18 being moved downwards relative to the body 16.

Figure 2:
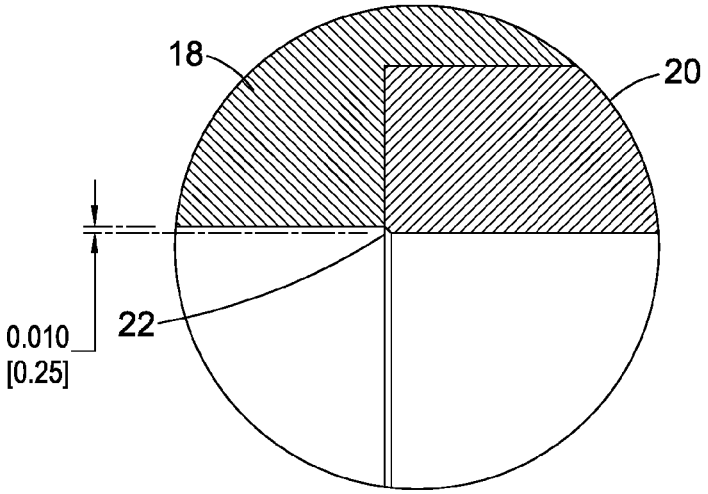
FIG. 2 is an enlarged view of area 2 of FIG. 1, showing a landing part of a seat of one of the tools.

Each sleeve 18 includes a seat insert 20 formed of a hard material, such as a ceramic or tungsten carbide. FIG. 2 of the drawings is an enlarged view of area 2 of FIG. 1, and illustrates that the inner diameter of the insert 20 is slightly smaller than the inner diameter of the respective sleeve 18, this differential forming a seat 22. It will also be noted that the upper edge of the insert 20 which defines the seat 22 has been formed at an angle. The angle of the seat 22 will typically be between 25 and 70°, and in the illustrated embodiment is 45°.

Each sleeve 18 features a recess 24 below the insert 20 to accommodate an activating device latch, as will be described.

In this particular example the sleeve 18*a* of the first tool 10 has an inner diameter of 2.250+/−0.001 inches (57.15+/−0.03 mm), while the insert 20*a* and thus the first seat 22*a* has an inner diameter of 2.230+/−0.001 inches (56.64+/−0.03 mm). The second tool 12 has a sleeve 18*b* with a slightly larger inner diameter of 2.270+/−0.001 inches (57.66+/−0.03 mm), and an insert 20*b* and thus the second seat 22*b* having an internal diameter of 2.250+/−0.001 inches (57.15+/−0.03 mm). The third tool 14 again features internal diameters slightly larger than the second tool, with a sleeve 18*c* having an inner diameter of 2.290+/−0.001 inches (58.17+/−0.03 mm), and the insert 20*c* and thus the third seat 22*c* having an inner diameter of 2.270+/−0.001 inches (57.66+/−0.03 mm).

Figure 3:
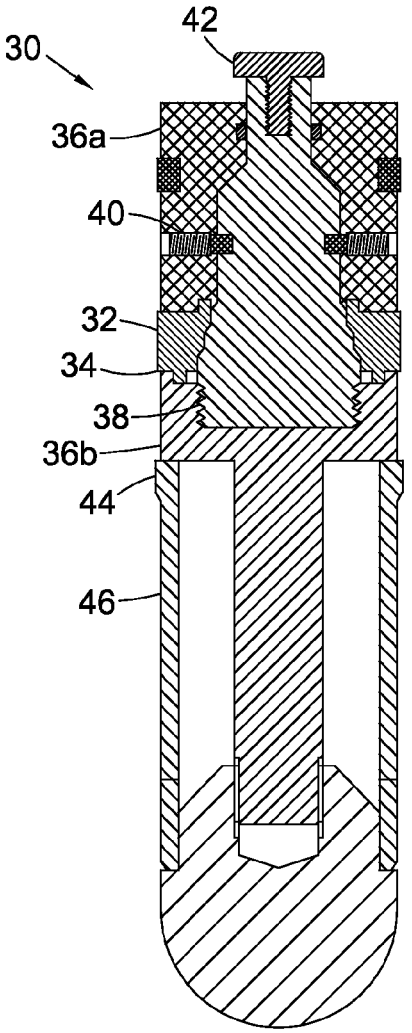
FIG. 3 is a sectional view of an activating device for use in activating the tools of FIG. 1.

Reference is now made to FIG. 3 of the drawings, which is a sectional view of an activating device in accordance with an embodiment of the present invention, for use in activating a selected one of the tools 10, 12, 14 of FIG. 1. The activating device 30 is similar to a device as described in the applicant's International Patent Application Publication No WO/2010/128287, and will be described in detail below. The device 30 includes a split ring 32 which defines an activating profile 34. The device 30 is illustrated showing the profile 34 in an extended configuration and defining an extended diameter.

For this embodiment at least three activating devices will be provided, each matched to a respective tool 10, 12, 14. The activating devices may take different forms (for example, see FIGS. 6 and 7) or may be very similar. For example, most of the features and dimensions of the three activating devices may be the same as will be assumed with reference to this first embodiment of the invention. The diameter of the nose of each activating device 30 of this embodiment is 2.225 inches (56.52 mm). However, the activating device 30 for activating the third tool 14 will have an activating profile 34 with an extended diameter of 2.285 inches (58.04 mm), the second activating device 30 for activating the second tool 12 an extended activating profile diameter of 2.265 inches (57.53 mm), and the first activating device 30 for activating the first tool 10 an extended activating profile diameter of 2.245 inches (57.02 mm). However, all of the activating devices will have an activating profile with a retracted diameter of less than 2.230 inches (56.64 mm), the inner diameter of the first seat 22*a*.

The activating device 30 will now be described in detail. The device 30 has a relatively short two-part body 36*a*, 36*b*. As noted above, the activation profile 34 is defined by a split ring 32, initially maintained in an extended position by a central support shaft 38. The shaft 38 is held relative to the upper body part 36*a* by shear pins 40. The lower end of the shaft 38 is threaded and engages the lower body part 36*b*. A cap 42 is provided on the uppermost portion of the shaft 38 forming a button extending above the activating device body.

The activating device 30 features a latch part 44 comprising a barbed collet 46 configured to engage with a catch 48 formed by the lower end of the insert 20, the collet head being accommodated by the recess 24.

The lower or leading end of the device 30 is formed by a rounded nose 50 having a diameter of 2.225 inches (56.52 mm).

In use, the activating device 30 is pumped into the string and lands in the sleeve 18 of the respective tool 10, 12, 14. The activating device 30 for the first tool 10 will pass through the third and second tools 14, 12 before landing in the sleeve 18*a*. The activating device 30 for the second tool 12 will pass through the third tool 14 before landing on the sleeve 18*b*. The activation profile 34 engages the respective activation seat 22, occluding the sleeve bore. Also, the collet 46 on the device 30 engages the catch 48 on the sleeve 18.

Fluid pressure thus may act on the sleeve 18 and activating device 30 and move the sleeve 18 downwards in the body 16 to activate, or initiate or allow activation of the respective tool 10, 12, 14.

Figure 4:
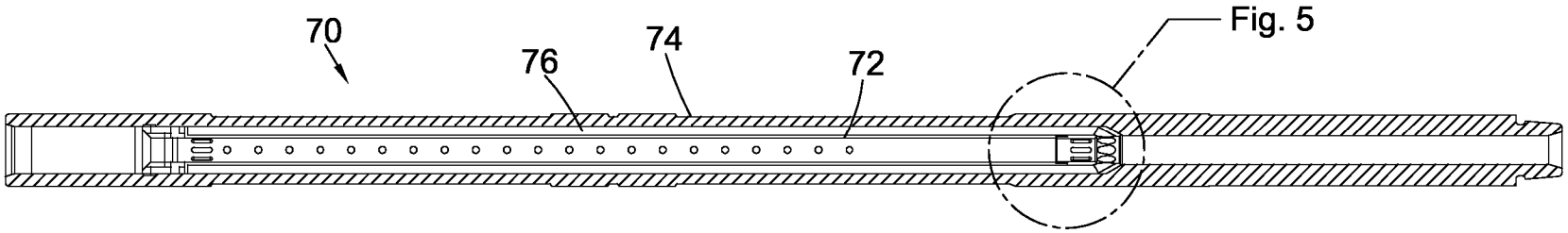
FIG. 4 is a sectional view of a catcher collar.

To release the device 30, and reinstate flow to the part of the string below the respective tool, a release device is dropped or pumped into the string and lands on the cap 42, pushing the shaft 38, with the lower body part 36*b*, downwards to remove support from the split ring 32. The split ring 32 may then radially contract out of engagement with the seat 22 and the device 30 then passes through the sleeve 18, and any tools 12, 10 and seats 22 in subsequent tools, and into a catcher collar 70 provided below the tools, and as will be described subsequently with reference to FIGS. 4 and 5 of the drawings.

If it is desired to activate the same tool again, another activating device with the same activating profile diameter may be pumped into the string. Alternatively, a first activating device may be used to re-configure the tool from a first configuration to second configuration, and a further activating device subsequently employed to re-configure the tool from the second configuration to a third configuration, or from the second configuration back to the first configuration. For example, if the tool is an ICD that is initially closed, an activating device may be used to open the ICD. Subsequently, another activating device may be utilised to close the ICD. If it is desired to activate one of the other tools, an activating device with an appropriately dimensioned activating profile extended diameter is pumped into the string to land on and activate that tool. This process may be repeated as many times as desired by the operator, the only limit being the number of activating devices available, or the space available in the catcher collar 70, as described below. Of course in some applications the operator may have no requirement to flow fluid to the distal end of the string, in which case the activating devices may simply gather in the end of the string or in the end of the bore.

Figure 5:
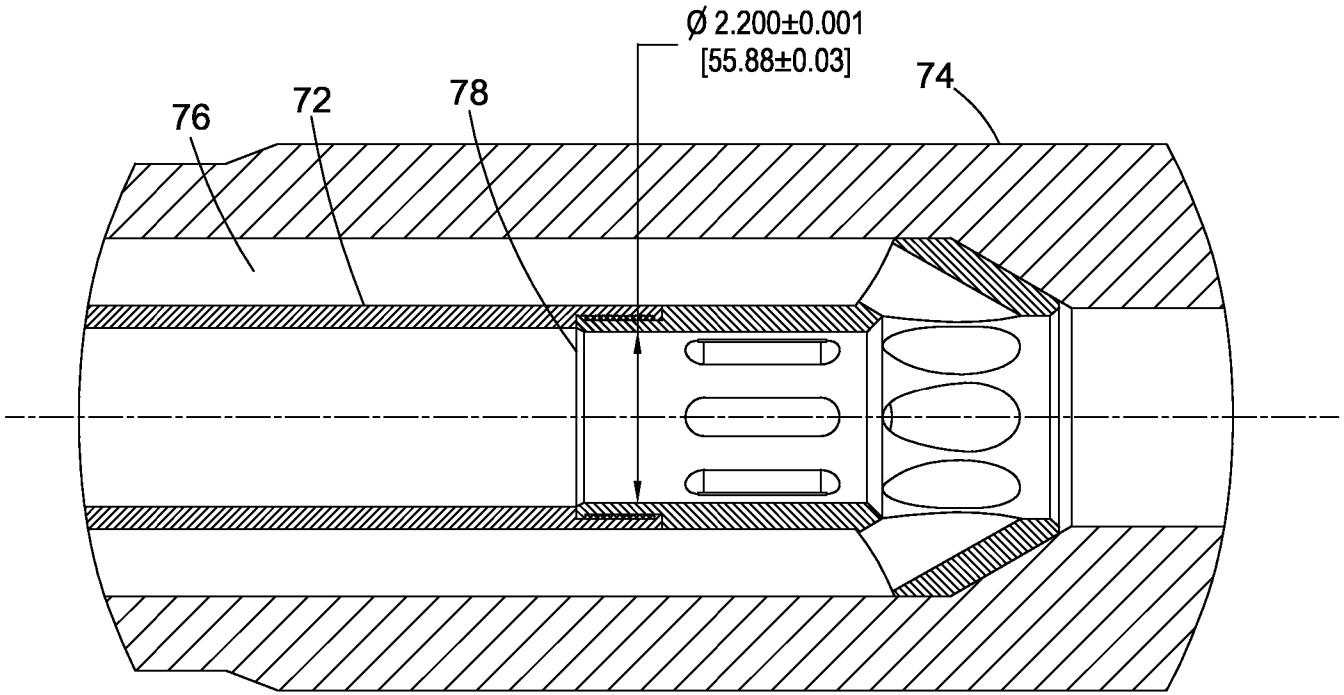
FIG. 5 is an enlarged view of area 5 of FIG. 4, showing a no-go at the bottom of the catcher collar.

The collar 70 includes a central tube 72 for accommodating activating devices 30, the tube 72 being mounted within a larger diameter body 74, configured to form part of the string, such that fluid bypass of the tube 72 may be provided through an annulus 76 between the tube 72 and the body 74. FIG. 5 is an enlarged view of area 5 of FIG. 4, and illustrates a no-go 78 provided at the lower end of the tube 72. The no-go has an inner diameter of 2.200+/−0.001 inches (55.88+/−0.03 mm), which is smaller than the diameter of the activating devices 30 with the activating profiles in the retracted configuration. Accordingly, the first activating device 30 to be released from its respective tool 10, 12, 14 will pass into the collar 70 and then pass down through the tube 72 until the nose 50 (diameter 2.225 inches/56.52 mm) engages the smaller diameter no-go 78. Further activating devices 30 are then accommodated in the tube 72 above the first activating device.

Figure 6:
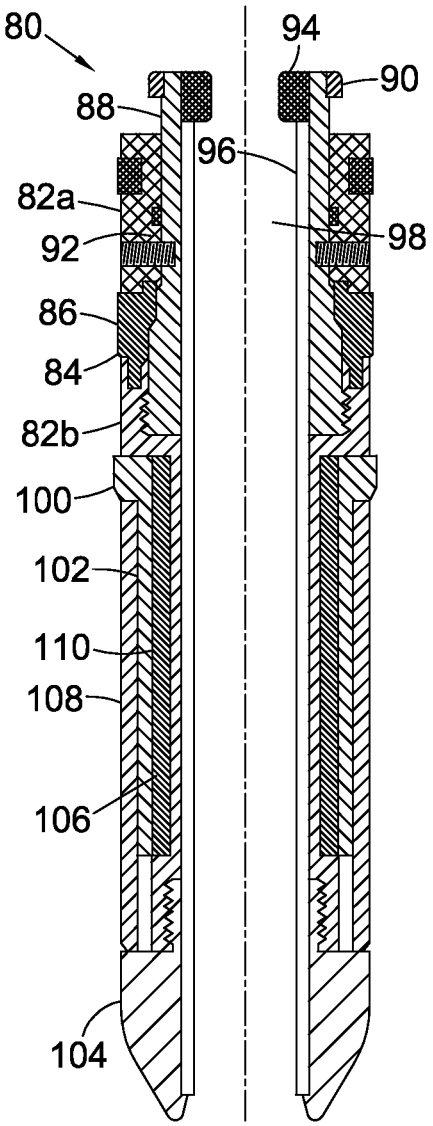
FIGS. 6 and 7 are sectional views of alternative activating devices for use in activating the tools of FIG. 1.

FIG. 6 of the drawings illustrates an activating device 80 intended to provide the possibility of continued flow through the landed device 80 and associated tool.

The device 80 features a relatively short body 82 and the activation profile 84 is defined by a split ring 86 located between two upper body parts 82*a*, 82*b* and initially maintained in an extended position by an annular central support 88. The support 88 is held in place relative to the upper body part 82*a* by shear pins 92 and the lower end of the support 88 is threaded to the lower body part 82*b*. The support 88 extends above the activating device body 82 and is thus available to be engaged by an appropriate release device, as will be described. An external retaining ring 90 is mounted on the upper end of the support 88 to prevent the released support 88 passing completely through the upper body part 82*a*, and ensuring that the body parts 82*a*, 82*b* remain coupled together.

The upper end of the support 88 is further provided with a flow restriction 94 defining a nozzle which serves to control the pressure drop across the activating device 80 while fluid is being pumped through the string. The restriction 94 is formed of a suitable erosion resistant material. Also, a sleeve 96 of an erosion resistant material, such as a ceramic, is used to line the throughbore 98 that extends through the device 80.

The activating device latch part 100 comprises a barbed collet 102 configured to engage with the catch 48 formed in the sleeve 18. The collet 102 is mounted in the lower body part 82*b* and is retained on the body part 82*b* by a threaded nose 104. The collet fingers 106 are sandwiched between an external sleeve 108 and a resilient internal sleeve 110. The sleeves 108, 110 support and protect the collet fingers 106 as the device 80 is being pumped down through the string.

In use, the activating device 80 is pumped into the string and lands in the sleeve 18 of the associated tool 10, 12, 14 in a similar manner to the activating device described above. The activation profile 84 engages the respective activation seat 22, restricting fluid passage through the sleeve bore. Also, the collet 102 on the device 80 engages the catch 48 on the sleeve 18.

If fluid is pumped down through the string, the flow restriction 94 creates a pressure differential across the device 80, and thus also across the sleeve 18. This pressure differential acts across the cross-sectional area of the sleeve 18 and moves the sleeve 18 downwards, activating the tool.

Unlike the activating device 30 as described above, the form of the activating device 80 allows fluid to continue to flow through the tool and the string, controlled to some extent by the flow restriction 94 provided in the device 80. The erosion-resistant liner 96 prevents the flow through the device 80 from eroding and damaging the device 80, and maintains the flow characteristics of the device 80 substantially constant.

To release the device 80, a release device is pumped into the string and lands on the protruding upper end of the support 88, shearing the pins 92 and pushing the support 88 and the lower body part 82*b* downwards to remove support from the split ring 86. The split ring 86 may then radially contract out of engagement with the seat 22 and the device 80 then passes through the sleeve 18, and any subsequent tool, and into the catcher collar 70.

Figure 7:
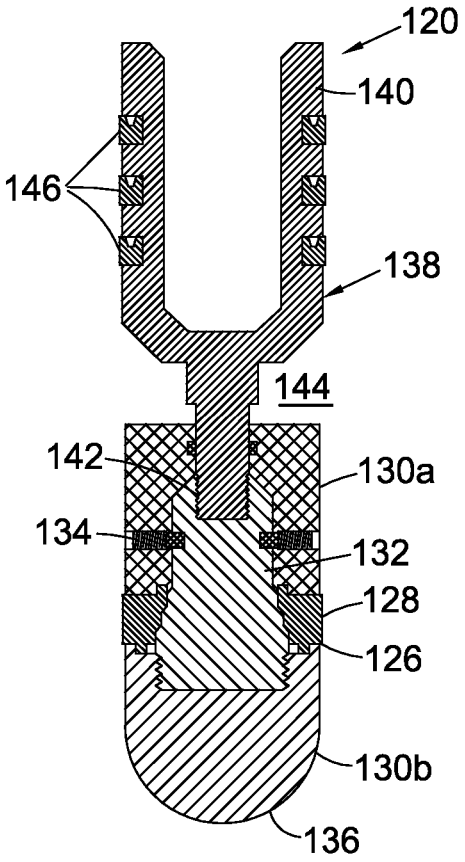

Reference is now made to FIG. 7 of the drawings, which illustrates an activating device 120 in accordance with an alternative embodiment of the present invention.

The device 120 shares a number of features with the device 30 described above with reference to FIG. 3. In particular, the activating profile 126 is defined by a split ring 128 mounted in a two-part body 130 and is initially maintained in an extended position by a central support shaft 132. The shaft 132 is held relative to the upper body part 130*a* by bronze or brass shear pins 134. The lower end of the shaft 132 is threaded and engages the lower body part 130*b*, which also forms a rounded nose 136 at the leading end of the device 120.

A closing sleeve 138 has a seal-carrying part 140 and a threaded lower end 142 which extends through the upper body part 130*a* and engages the shaft 132, leaving a space 144 between the part 140 and the body 130. The sleeve 138 features three independent seals 146 sized to form a sealing fit with the internal diameter of the sleeve 18, and thus the seals 146 describe a larger diameter than the profile 126. The provision of the three seals minimises the risk of failure, providing two back-up seals. If desired, a sleeve 18 having a longer bore may be provided such that an emergency disconnect sleeve with further seals may be landed on top of the part 140 in the event of total seal failure.

The mating faces of the activating profile 126 and the activation seat 22 are formed at a complementary angle, in this embodiment 45°. The selection of an appropriate profile/seat angle assists in minimizing the friction that results from the split ring 128 being radially compressed and pushed into tighter contact with the shaft 132; at shallower angles the radial force and resulting friction can make it more difficult to push the shaft 132 down through the split ring 128 and de-support the ring 128. The friction between the shaft 132 and ring 128 may also be reduced by provision of appropriate materials, surface finishes and coatings, and by filling the small voids within the body 130 with grease. The grease of course reduces friction and also assists in prevention of ingress of drilling mud and other materials which could adversely affect relative movement of the contacting faces.

In use, the device 120 may be pumped into and though a string of tubing in a similar manner to the other devices described above. As the device 120 passes through the tubing the device 120 will serve to drift the tubing, that is establish the tubing is free from obstruction and will permit subsequent passage of a device of the same or smaller diameter. The device 120 will pass through the string until the activating profile 126 engages the appropriate activation seat 22. The seals 146 form a sealing contact with the sleeve 18 (there are no seals on the body 130), such that the device 120 plugs the string.

Those of skill in the art will recognise that the device 120 will land in the sleeve with significant force, due to the momentum of the device 120 and the momentum and pressure of the fluid being pumped after the device 120. With this in mind, the device 120 is constructed to have a relatively low mass. Also, given that the device 120 is configured to be released from the seat 22 using elevated pressure, an operator should not seek to pump the device 120 at an elevated rate, to avoid the creation of pressure pulse on the device 120 landing on the seat 22 that might be sufficient to release the device 120. Furthermore, despite the relatively small overlap between the profile 126 and the seat 22, the device 120 is not extruded or forced past the seat 22.

Pressure may then be increased above the device 120. This pressure creates a downwards pressure force on the seal-carrying part 140. However, downwards movement of the part 140, and the attached shaft 132, relative to the seat-held-up split ring 128, is resisted by the shear pins 134. The relatively high pressure above the device 120 may be used to move the respective sleeve and activate the respective tool directly or the sleeve may be fixed and the pressure utilised to, for example, activate a pressure actuated or activated tool (for example a tool actuated by a differential pressure between the string bore and the annulus); or pressure test the string. Alternatively, the device 120 and tool combination may simply serve as a plug.

Once the task or function has been completed, the device 120 may be moved from the sleeve 18, and flow through the string reinstated, as described below.

Increasing pressure above the device 120 sufficiently to shear the pins 134 causes the shaft 132 to move downwards and remove the radial support for the split ring 128, such that the ring 128 may radially contract and the profile 126 disengage from the seat 22. The small radial extent of the seat 22 facilitates disengagement of the profile 126 and seat 22 and also passage of the seals 146 through the seat 22. The provision of the space 144 between the seal-carrying part 140 and the body 130 minimizes the possibility of a solid object trapped between the parts 140, 130 preventing the required relative movement. The device 120 may then pass through the sleeve 18, and pass into the catcher 70, leaving uninhibited flow through the sleeve 18. If desired or necessary, one or more further devices 120 may be pumped into the sleeve and further functions or tasks carried out.

From the above description it will be apparent that the various embodiments of the present invention provide an apparatus and method that permits an operator to activate a number of tools in a tubing string in any desired order, or on any desired number of occasions.

The person skilled in the art will also appreciate that individual features of the various aspects and embodiments may have utility in isolation from other features of the aspects and embodiments and that one or more individual features of one aspect or embodiment may be combined with one or more individual features of another aspect or embodiment.

The invention claimed is:

1. Downhole apparatus comprising:

first and second tools for location in a tubing string, the first tool having a first seat of a first diameter and the second tool having a second seat of a second diameter larger than the first diameter, and first and second activating devices for use in activating the respective first and second tools, the first activating device including a first activating profile having an extended diameter larger than the first diameter and smaller than the second diameter and a retracted diameter smaller than the first diameter, and the second activating device including a second activating profile having an extended diameter larger than the second diameter and a retracted diameter smaller that the first diameter.

2. The apparatus of claim 1, further comprising a third tool and a third activating device, the third tool having a third seat of a third diameter larger than the second diameter, and the third activating device including a third activating profile having an extended diameter larger than the third diameter and a retracted diameter smaller that the first diameter.

3. The apparatus of claim 1, further comprising a tubing string.

4. The apparatus of claim 3, wherein the tubing string is at least one of: a drill string, fishing string, milling string, running string, tool string, casing, liner, or a completion.

5. The apparatus of claim 1, wherein the tools are one or more of: drill bits, reamers, downhole motors, agitators, MWD tools, LWD tools, downhole steering tools, stabilisers, under-reamers, bypass tools, fishing tools, milling tools, cutting tools, tubing expanders, setting tools, packers, valves, plugs, hangers, perforating guns, or inflow control devices (ICDs).

6. The apparatus of claim 1, wherein the first and second tools form part of a single tool or apparatus requiring or capable of multiple activations.

7. The apparatus of claim 1, wherein the tools perform a similar function and are located at spaced locations in the string.

8. The apparatus of claim 1, wherein the tools perform different functions.

9. The apparatus of claim 1, wherein at least two activating devices are of the same or similar form.

10. The apparatus of claim 1, wherein at least two activating devices are of different forms.

11. The apparatus of claim 1, wherein at least one activating device substantially occludes the string when landed on the respective seat.

12. The apparatus of claim 1, wherein at least one activating device only partially occludes the string when landed on the respective seat.

13. The apparatus of claim 1, wherein at least one activating device includes a flow restriction.

14. The apparatus of claim 1, wherein at least one activating device includes a flow restriction configured to resist wear.

15. The apparatus of claim 1, wherein at least one activating device includes a flow restriction configured to erode such that the degree of occlusion provided by the restriction reduces over time.

16. The apparatus of claim 1, wherein at least one activating profile is formed by a member retractable from the extended diameter to define a smaller retracted diameter.

17. The apparatus of claim 1, wherein at least one activating profile is biased to assume the extended diameter.

18. The apparatus of claim 1, wherein at least one activating profile is biased to assume the retracted diameter.

19. The apparatus of claim 1, wherein at least one activating profile is formed by a member radially supported to define the extended diameter, whereby removal of the radial support permits movement of the member to define the retracted diameter.

20. The apparatus of claim 1, wherein at least one activating profile is formed by a split ring.

21. The apparatus of claim 1, wherein at least one activating profile is formed by one or more dogs or keys.

22. The apparatus of claim 1, wherein at least one activating profile is reconfigurable by elevated fluid pressure.

23. The apparatus of claim 1, wherein at least one activating profile is reconfigurable by mechanical force.

24. The apparatus of claim 1, comprising at least one release device operable to reconfigure an activating profile.

25. The apparatus of claim 24, wherein the release device is configured to be passed through the string to reconfigure an activating profile.

26. The apparatus of claim 24, wherein the activating profile is integral with each, activating device and is contracted out of engagement with the seat by the release device.

27. The apparatus of claim 1, wherein at least one seat and at least one profile is formed of a non-deformable material.

28. The apparatus of claim 1, further comprising an activating device catcher.

29. The apparatus of claim 28, wherein the catcher is located below the first tool.

30. The apparatus of claim 28, wherein the catcher is arranged to permit fluid bypass around an activating device in the catcher.

31. The apparatus of claim 28, wherein the catcher no-go with a diameter smaller than the first diameter.

32. The apparatus of claim 28, wherein the catcher is dimensioned to accommodate multiple activating devices.

33. The apparatus of claim 1, wherein at least one tool includes a seal for cooperating with the respective activating device.

34. The apparatus of claim 1, wherein at least one activating device includes a seal for cooperating with the respective tool.

35. The apparatus of claim 1, wherein at least one activating device and respective seat includes a latch arrangement.

36. A tool activating method comprising:

providing first and second tools in a tubing string, the second tool being located above the first tool in the string, the first tool having a first seat of a first diameter and the second tool having a second seat of a second diameter larger than the first diameter;

providing first and second activating devices for use in activating the respective first and second tools, the first activating device including a first activating profile with an extended diameter larger than the first diameter and smaller than the second diameter and a retracted diameter smaller than the first diameter, and the second activating device having a second activating profile with an extended diameter larger than the second diameter and a retracted diameter smaller that the first diameter;

passing the second activating device through the string such that the second activating profile engages the second seat;

activating the second tool;

retracting the second activating profile from the extended diameter to the retracted diameter; and passing the second activating device through the second seat and then through the first seat.

37. The method of claim 36, further comprising:

passing the first activating device through the string such that the first activating device passes through the second tool and the first activating profile then engages the first seat;

activating the first tool;

retracting the first activating profile from the extended diameter to the retracted diameter, and passing the first activating device through the first seat.

38. The method of claim 37, comprising passing the first activating device through the string after the second activating device.

39. The method of claim 36, further comprising:

providing a third tool and a third activating device, the third tool being located in the string above the second tool and having a third seat of a third diameter larger than the second diameter, and the third activating device including a third activating profile having an extended diameter larger than the third diameter and a retracted diameter smaller that the first diameter, passing the third activating device through the string such that the third activating profile engages the third seat;

activating the third tool;

retracting the third activating profile from the extended diameter to the retracted diameter; and passing the third activating device through the third seat, then through the second seat, and then through the first seat.

* * * * *